US005400849A

United States Patent [19]

Sasaki et al.

[11] Patent Number: 5,400,849

[45] Date of Patent: Mar. 28, 1995

[54] TWIN-DRUM TYPE CONTINUOUS CASTING APPARATUS

[75] Inventors: Kunimasa Sasaki, Hiroshima; Youichi Wakiyama, Hiroshima; Takashi Arai; Hideki Oka, both of Hikari, all of Japan

[73] Assignees: Mitsubishi Jukogyo Kabushiki Kaisha; Nippon Steel Corporation, both of Tokyo, Japan

[21] Appl. No.: 18,322

[22] Filed: Feb. 16, 1993

[30] Foreign Application Priority Data

Feb. 17, 1992 [JP] Japan ..... 4-29175

[51] Int. Cl.[6] ..... B22D 11/06

[52] U.S. Cl. ..... 164/416; 164/428

[58] Field of Search ..... 164/428, 480, 416, 478

[56] References Cited

FOREIGN PATENT DOCUMENTS 3-174954 7/1991 Japan ..... 164/428

WO/9216323 10/1992 WIPO .

OTHER PUBLICATIONS

Patent Abstracts of Japan, vol. 15, No. 414 (M-1171) Oct. 22, 1991.

Patent Abstracts of Japan, vol. 11, No. 125 (M-582)(2572) Apr. 18, 1987.

*Primary Examiner*—Kuang Y. Lin

*Attorney, Agent, or Firm*—Wenderoth, Lind & Ponack

[57] ABSTRACT

The present invention provides a twin-drum type continuous casting apparatus in which, when a side weir is vibrated at a high speed, vibrations of the side weir in the axial direction of the cooling drums is suppressed. The generation of run-out from a cast piece is prevented, and the elongation of the lives of the side weirs and the refractory materials is made possible. A pair of side weirs vibrating along end surfaces of cooling drums are characterized in that a support shaft serving as a center of rotation of the vibrations of the side weirs is disposed lower than the molten metal surface and higher than a minimum gap position of the cooling drums. A vibration exciting shaft for applying vibration to the side weir is disposed lower than the above-mentioned minimum gap position.

12 Claims, 3 Drawing Sheets

TWIN-DRUM TYPE CONTINUOUS CASTING APPARATUS

BACKGROUND OF THE INVENTION

1. Field of the Invention

The present invention relates to a twin-drum type continuous casting apparatus provided with a vibration exciting means in a side weir.

2. Description of the Prior Art

A twin-drum type continuous casting apparatus has a basin formed by a pair of rotary cooling drums and a pair of side weirs pressed to both the end surfaces of these drums. While molten metal is being fed to this basin, a belt-like cast piece is ejected downwards from the gap between the cooling drums. It has heretofore been the practice to cause the side weir to vibrate along the end surface of the cooling drum for the purpose of preventing a solidified shell from fixedly securing to the side weir.

In the following, description will be made of a side weir vibrating device in a twin-drum type continuous casting apparatus in the prior art with reference FIGS. 3 and 4. FIG. 3 is a side view of the side weir vibrating device, in which an essential portion is partly cut away, and FIG. 4 is a cross-sectional view taken along line IV—IV in FIG. 3 as viewed in the direction of the arrows.

In this casting apparatus, side weirs 52 are pressed against a pair of cooling drums 51 by means of pressing devices 42 via vibrating plates 31, and a basin is thereby formed in the space delimited by the pair of drums 51 and the side weirs 52 on opposite sides thereof. The cooling drums 51 rotate while being held in sliding contact with refractory materials 53 on the surfaces of the side weirs 52. On the rear surface of the vibrating plate 31 fixed to each side weir 52 are provided a bearing 37 and a guide 34. Within the guide 34 is fitted a slider 33 so as to be slidable in the vertical direction along the guide. A support shaft 36 is fixedly provided on a frame 41 and is rotatably inserted in the bearing 37. An eccentric tip end portion of a vibration exciting shaft 32 is rotatably supported from the frame 41 and pivotably mounted to the slider 33. In this way, when the vibration exciting shaft 32 is rotated by means of a driving unit (not shown), the slider 33 vibrates the vibrating plate 31 about the support shaft 36 while sliding within the guide 34.

In a continuous casting operation, the pair of cooling drums 51 are rotated in the direction of the arrows shown thereon, the side weirs 52 are pressed against the opposite end surfaces of the cooling drums 51 by means of the pressing devices 42, and while the side weirs 52 are vibrated about the support shafts 36 in the direction of the arrows shown at the location of the guide 34 in FIG. 4, molten metal is fed from a gate (not shown) disposed above the above-described basin into the basin. Then, molten metal 61 in the basin is cooled by the cooling drums 51, and thereby a solidified shell is formed on the surface, while a belt-like cast piece 62 is ejected from below. At that time, by vibrating the side weirs 52, the solidified shell is prevented from fixedly securing to the refractory materials 53 on the surfaces of the side weirs 52.

In the above-described side weir vibrating device in the prior art, due to the fact that the support shaft 36 is disposed lower than the position of the minimum gap space between the rotary cooling drum 51 (hereinafter called the "kissing point") and that the vibrating shaft 32 is disposed in the middle between molten metal surface 60 and the kissing point, the side weir 52 is reciprocated in the lateral direction by the vibrating shaft 32 disposed in the vicinity of its center of gravity, and is rotated about the support shaft 36 under the kissing point.

Since the vibration exciting force generated by the vibrating shaft 32 for the side weir 52 is applied in the vicinity of the center of gravity of the side weir 52, because of the large moment of inertia due to rotation of the side weir 52 about the support shaft 36 upon high-speed vibration, the side weir 52 would vibrate also in the axial direction of the cooling drums 51, and hence there is a shortcoming in that a gap clearance is produced momentarily between the refractory material 53 of the side weir 52 and the end surfaces of the cooling drums 51, and at the next moment the refractory material 53 would collide against the end surfaces of the cooling drums 51, and thereby run-out Would be generated in a cast piece, or the life of the refractory material would be shortened.

SUMMARY OF THE INVENTION

It is therefore one object of the present invention to provide a twin-drum type continuous casting apparatus, in which the above-mentioned shortcoming of the apparatus in the prior art can be eliminated, the vibration of side weirs in the axial direction of cooling drums can be suppressed even when the side weirs are vibrated at a high speed, the generation of run-out in a cast piece is prevented, and the lives of the side weirs and refractory materials is elongated.

According to one feature of the present invention, there is provided a twin-drum type continuous casting apparatus in which a basin is formed by a pair of cooling drums juxtapositioned and rotating in opposite directions to each other and a pair of side weirs vibrating along end surfaces of the drums. While molten metal is being fed to the basin, a belt-like cast piece is ejected downwards from a gap between the drums. A support shaft, serving as a center of rotation of the vibrations is disposed lower than a molten metal surface and higher than a minimum gap position (kissing point) of the drums. A vibration exciting means for applying the aforementioned vibration is disposed lower than the minimum gap position (kissing point).

As described above, in the twin-drum type continuous casting apparatus according to the present invention, owing to the fact that the side weirs are vibrated with a small amplitude by means of vibration exciting shafts disposed lower than the kissing point of the cooling drums about support shafts disposed lower than the molten metal surface and higher than the kissing point, preferably in the vicinity of the centers of gravity of the side weirs or the centers of gravity of the surfaces of the side weirs held in contact with the molten metal, the moment of inertia of the side weirs rotating about the support shaft can be made small, and vibration of the side weirs in the axial direction of the cooling drums can be prevented. As a result, a gap is not produced between the side weirs and the cooling drums, run-out from a cast piece is prevented, and the lifes of side weirs and the refractory materials provided on their surfaces are elongated.

BRIEF DESCRIPTION OF THE DRAWINGS

The above-mentioned and other objects, features and advantages of the present invention will become more apparent by reference to the following description of one preferred embodiment of the invention, taken in conjunction with the accompanying drawings, in which.

DESCRIPTION OF THE PREFERRED EMBODIMENT

Figure 1:
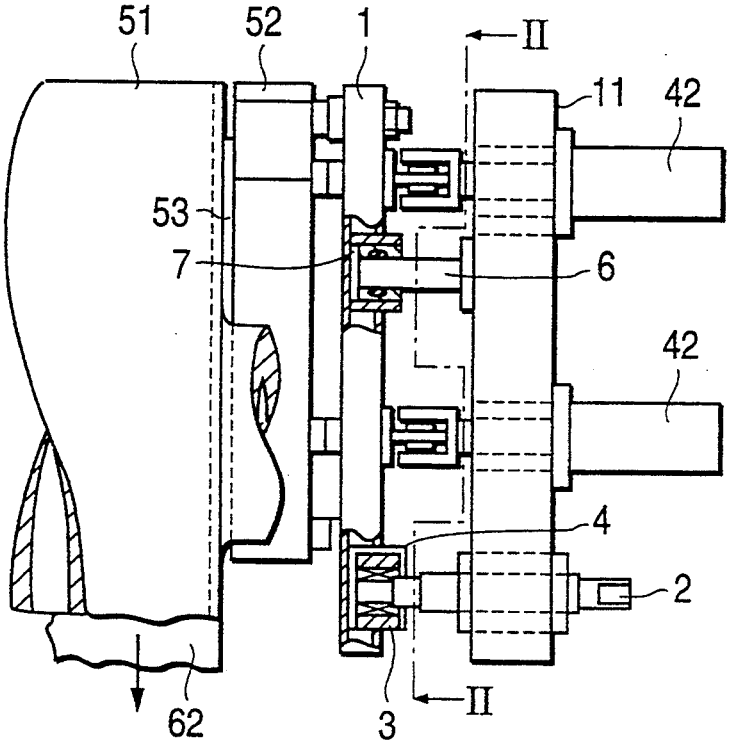
FIG. 1 is a side view, partly cut away, of a side weir vibrating device in a twin-drum type continuous casting apparatus according to one preferred embodiment of the present invention.

In the following, a twin-drum type continuous casting apparatus according to the present invention will be described in detail with respect to one preferred embodiment.

In the illustrated apparatus, a basin is formed by urging respective side weirs 52 against a pair of cooling drums 51 via respective vibrating plates 1 by means of pressing devices 42. The cooling drums 51 rotate while being kept in sliding contact with refractory materials 53 on the surfaces of the respective side weirs 52. On the rear surfaces of the vibrating plates 1 fixed to the side weirs 52 are provided bearings 7 at positions lower than a molten metal surface 60 and higher than a kissing point of the cooling drums 51, and preferably in the vicinity of the centers of gravity of the side weirs or the centers of gravity of the surfaces of the side weirs held in contact with the molten metal 61. Guides 4 are provided lower than the kissing point of the cooling drums, sliders 3 are slidably fitted in the respective guides 4, tip end portions of support shafts 6, fixedly provided on a frame 11, are rotatably inserted in respective bearings 7 fixedly secured to the respective vibrating plates 1, and eccentric tip end portions of vibration exciting shafts 2, rotatably supported from the frame 11, are pivotably mounted to the respective sliders 3. With such an arrangement, if the vibration exciting shaft 2 is rotated by a drive unit (not shown), the slider 3 reciprocates while sliding in the corresponding guide 4 and causes the vibrating plate 1 to vibrate with a small amplitude along a circular arc passing through the axis of the vibration exciting shaft 2 and about the axis of the support shaft 6, and thereby the side weir 52 fixed to the vibrating plate 1 is vibrated. Since the side weir 52 can reduce its moment of inertia in vibration as a result of the fact that it is rotated about a point close to its center of gravity, vibration of the side weir 52 in the axial direction of the cooling drums can be prevented. In this connection, the frequency of the vibration applied to the side weir 52 is 15–20 Hertz.

Figure 2:
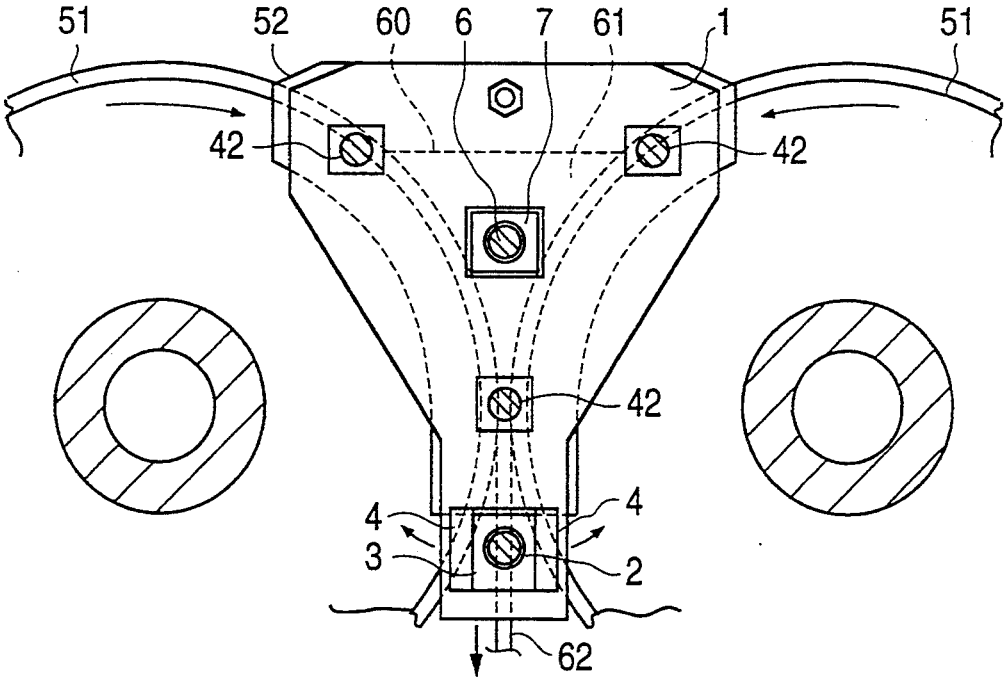
FIG. 2 is a cross-sectional view taken along line II—II in FIG. 1 and as viewed in the direction of the arrows.
Figure 3:
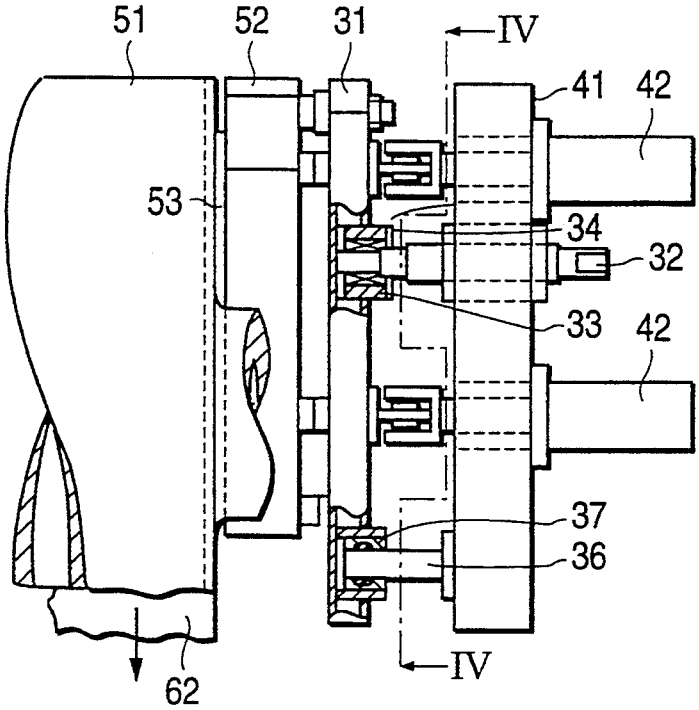
FIG. 3 PRIOR ART
FIG. 3 is a side view partly cut away of a side weir vibrating device in a twin-drum type continuous casting apparatus in the prior art.
Figure 4:
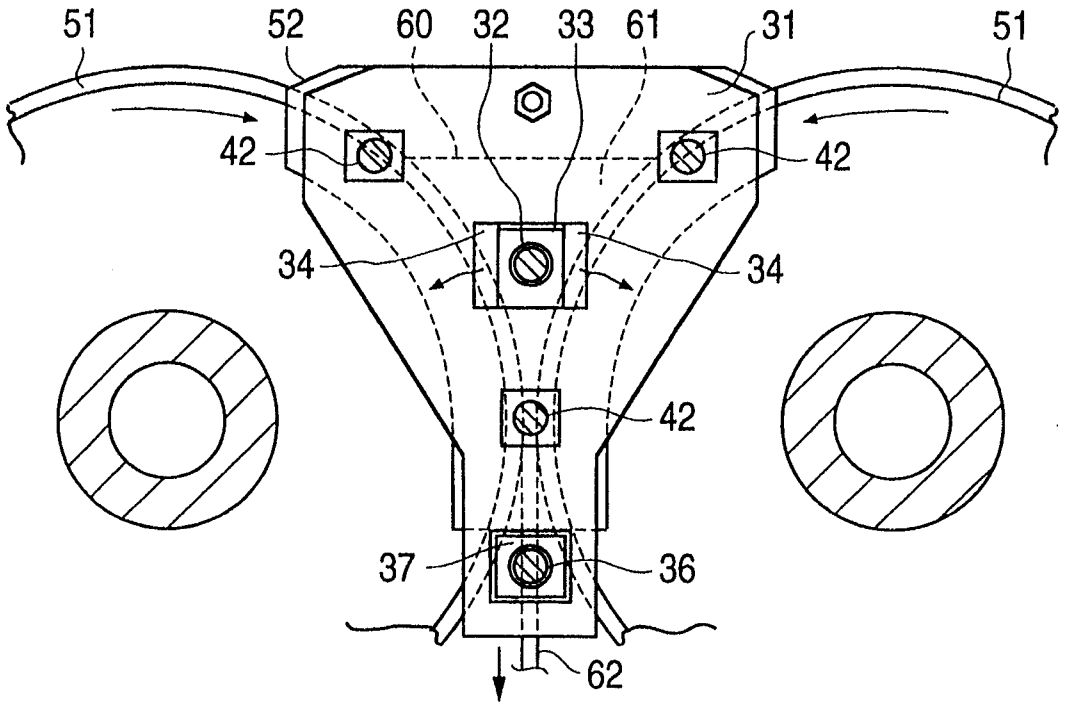
FIG. 4 PRIOR ART
FIG. 4 is a cross-sectional view taken along line IV—IV in FIG. 3 and as viewed in the direction of the arrows.

In a continuous casting operation, the pair of cooling drums 51 are rotated in the direction of the arrows in FIG. 2, the side weirs 52 are urged against the opposite end surfaces of the cooling drums 51 by means of pressing devices 42, and while the side weirs 52 are vibrated about the axes of the respective support shafts 6 in the direction of arrows indicated at the position of the guide 4 in FIG. 2, molten metal is fed from a gate (not shown) provided above a basin formed in the space delimited by the cooling drums 51 and the side weirs 52 on both sides of the cooling drums 51. Molten metal 61 in the basin is cooled by the cooling drums 51, a solidified shell is thereby formed on the surface, and a belt-like cast piece 62 is ejected below. At that time, the side weirs 52 vibrate along the end surfaces of the cooling drums 51 to prevent the solidified shell from adhering to refractory materials 53 on the surfaces of the side weirs 52, but since vibrations in the axial direction of the cooling drums can be prevented, it would never occur that a gap clearance is produced between the refractory material 53 on the surface of the side weir 52 and the end surfaces of the cooling drums 51, and run-out from a cast piece is not produced. As collision between the refractory materials 53 and the cooling drums 51 are also suppressed, it has become possible to elongate the life of the side weirs 52 and the refractory materials 53.

Furthermore, according to the present invention, by employing the above-mentioned construction and disposing a support shaft of a vibrating plate higher than a kissing point of the cooling drums, the moment of inertia of the side weir, with respect to rotation, can be made small. As a result, vibrations of the side weir in the axial direction of the cooling drums can be prevented, and thereby it has been made possible to prevent run-out from a cast piece and to elongate the lives of the side weirs and the refractory materials held in sliding contact with the end surfaces of the cooling drums.

While an apparatus according to the present invention has been described above on the basis of one preferred embodiment illustrated in the drawings, it is a matter of course that the present invention should not be limited to the illustrated embodiment and that many changes and modifications could be made thereto without departing from the spirit of the invention.

What is claimed is:

1. A continuous casting apparatus, comprising:

a pair of juxtaposed cooling drums rotatable in opposite rotational directions, said cooling drums being disposed with a gap therebetween having a minimum gap position, and said cooling drums having end surfaces;

a pair of side weirs mounted for vibration along said end surfaces of said cooling drums;

a basin formed by said cooling drums and said side weirs for receiving molten metal and ejecting a cast piece through said gap between said cooling drums;

support shafts rotatably connected to respective said side weirs supporting said side weirs for rotational vibration about a point located above said minimum gap position; and a vibration connection on each said side weir connecting said side weir to a vibration applying mechanism, said vibration connection being disposed on said side weir below said minimum gap position.

2. The continuous casting apparatus of claim 1, wherein each said vibration connection comprises a guide on a side of a respective said side weir guiding a slide in the vertical direction, and said vibration applying mechanism comprises an eccentric rotary shaft rotatably coupled to said slider.

3. The continuous casting apparatus of claim 2, wherein each said side weir comprises a side weir portion having an inner surface disposed against an end surface of said cooling drums and an outer surface having a vibrating plate fixed thereto, said vibrating plate having said vibration connection thereon and said support shaft rotatably connected thereto.

4. The continuous casting apparatus of claim 3, wherein each said support shaft is rotatably connected to its respective said side weir at the center of gravity thereof.

5. The continuous casting apparatus of claim 4, wherein each said support shaft is rotatably connected to its respective said side weir by a bearing on said side weir rotatably connected to said support shaft.

6. The continuous casting apparatus of claim 3, wherein each said support shaft is rotatably connected to its respective said side weir by a bearing on said side weir rotatably connected to said support shaft.

7. The continuous casting apparatus of claim 2, wherein each said support shaft is rotatably connected to its respective said side weir at the center of gravity thereof.

8. The continuous casting apparatus of claim 2, wherein each said support shaft is rotatably connected to its respective said side weir by a bearing on said side weir rotatably connected to said support shaft.

9. The continuous casting apparatus of claim 1, wherein each said side weir comprises a side weir portion having an inner surface disposed against an end surface of said cooling drums and an outer surface having a vibrating plate fixed thereto, said vibrating plate having said vibration connection thereon and said support shaft rotatably connected thereto.

10. The continuous casting apparatus of claim 1, wherein each said support shaft is rotatably connected to its respective said side weir at the center of gravity thereof.

11. The continuous casting apparatus of claim 1, wherein each said support shaft is rotatably connected to its respective said side weir by a bearing on said side weir rotatably connected to said support shaft.

12. The continuous casting apparatus of claim 1, wherein molten metal in said weir has a molten metal surface, and said point about which said weirs are supported for rotational vibration is located below the molten metal surface.

* * * * *